US006929697B2

(12) United States Patent
Bergmann et al.

(10) Patent No.: US 6,929,697 B2
(45) Date of Patent: Aug. 16, 2005

(54) DEVICE FOR HOT DIP COATING METAL STRANDS

(75) Inventors: Frank Bergmann, Magdeburg (DE); Michael Zielenbach, Siegen (DE); Walter Trakowski, Duisburg (DE); Olaf Norman Jepsen, Siegen (DE); Holger Behrens, Erkrath (DE)

(73) Assignee: SMS Demag AG, Düsseldorf (DE)

( * ) Notice: Subject to any disclaimer, the term of this patent is extended or adjusted under 35 U.S.C. 154(b) by 0 days.

(21) Appl. No.: 10/503,871

(22) PCT Filed: Feb. 20, 2003

(86) PCT No.: PCT/EP03/01722

§ 371 (c)(1),
(2), (4) Date: Aug. 6, 2004

(87) PCT Pub. No.: WO03/076681

PCT Pub. Date: Sep. 18, 2003

(65) Prior Publication Data

US 2005/0076835 A1 Apr. 14, 2005

(30) Foreign Application Priority Data

Mar. 9, 2002 (DE) ..... 102 10 429

(51) Int. Cl.[7] ..... B05C 3/12
(52) U.S. Cl. ..... 118/419; 118/420; 118/429
(58) Field of Search ..... 118/419, 420, 429, 118/405; 427/431, 434.6

(56) References Cited

U.S. PATENT DOCUMENTS 6,106,620 A * 8/2000 Morrison et al. ..... 118/429
6,159,293 A * 12/2000 Kolesnichenko et al. ... 118/623
6,290,776 B1 * 9/2001 Tada et al. ..... 118/405

FOREIGN PATENT DOCUMENTS

WO 9711206 3/1997
WO 0171051 9/2001

* cited by examiner

*Primary Examiner*—Laura Edwards
(74) *Attorney, Agent, or Firm*—Friedrich Kueffner

(57) ABSTRACT

The invention relates to a device for hot dip coating metal strand (1), particularly strip steel, in which the metal strand (1) can be vertically guided through a reservoir (3), which accommodates the molten coating metal (2), and though a guide channel (4) connected upstream therefrom. An electromagnetic inductor (5) is mounted in the area of the guide channel (4) and in order to retain the coating metal (2) inside the reservoir (3), can induce induction currents in the coating metal (2) by an electromagnetic traveling field. While interacting with the electromagnetic traveling field, the induction currents exert an electromagnetic force. The inductor (5) has at least two main coils (6) that are arranged in succession in movement direction (X) of the metal strand (1), and has at least two correction coils (7) for controlling the position of the metal strand (1) inside the guide channel (4) in direction (N), which is normal to the surface of the metal strand (1). These correction coils are also arranged in succession in movement direction (X) of the metal strand (1). In order to improve the efficiency of the control of the metal strip inside the guide channel, the invention provides that at least a portion of the correction coils (7), when viewed in movement direction (X) of the metal strand (1), are arranged so that they are offset with regard to one another perpendicular to movement direction (X) and perpendicular to direction (N) that is normal to the surface of the metal strand (1).

13 Claims, 2 Drawing Sheets

DEVICE FOR HOT DIP COATING METAL STRANDS

The invention concerns a device for the hot dip coating of metal strands, especially steel strip, in which the metal strand can be passed vertically through a tank that contains the molten coating metal and through an upstream guide channel. In the area of the guide channel, an electromagnetic inductor is installed, which induces induction currents in the coating metal for holding back the coating metal in the tank by means of an electromagnetic traveling field. The induction currents interact with the electromagnetic traveling field to exert an electromagnetic force. The inductor has at least two main coils, which are arranged in succession in the direction of movement of the metal strand, and at least two correction coils, which serve to control the position of the metal strand in the guide channel in the direction normal to the surface of the metal strand and are also arranged in succession in the direction of movement of the metal strand.

Conventional metal dip coating systems for metal strip have a high-maintenance part, namely, the coating tank and the fixtures it contains. Before being coated, the surfaces of the metal strip to be coated must be cleaned of residual oxide and activated to allow bonding with the coating metal. For this reason, the surfaces of the strip are subjected to a heat treatment in a reducing atmosphere before they are coated. Since the oxide coatings are first removed by chemical or abrasive methods, the reducing heat treatment activates the surfaces, so that after the heat treatment, they are present in pure metallic form.

However, the activation of the strip surface increases the affinity of the strip surface for the surrounding atmospheric oxygen. To prevent the surface of the strip from being re-exposed to atmospheric oxygen before the coating process, the strip is introduced into the hot dip coating bath from above in a dipping snout. Since the coating metal is present in the molten state, and since one would like to utilize gravity together with blowing devices to adjust the coating thickness, but the subsequent processes prohibit strip contact until the coating metal has completely solidified, the strip must be deflected in the vertical direction in the coating tank. This is accomplished with a roller that runs in the molten metal. This roller is subject to strong wear by the molten coating metal and is the cause of shutdowns and thus loss of production.

The desired low coating thicknesses of the coating metal, which vary in the micrometer range, place high demands on the quality of the strip surface. This means that the surfaces of the strip-guiding rollers must also be of high quality. Problems with these surfaces generally lead to defects in the surface of the strip. This is a further cause of frequent plant shutdowns.

In addition, previous hot dip coating systems have limiting values in their coating rates. These limiting values are related to the operation of the stripping jets, to the cooling processes of the metal strip passing through the system, and to the heat process for adjusting alloy coatings in the coating metal. As a result, the maximum rate is generally limited, and certain types of metal strip cannot be conveyed at the plant's maximum possible rate.

During the hot dip coating process, alloying operations for the bonding of the coating metal to the surface of the strip are carried out. The properties and thicknesses of the alloy coatings that form are strongly dependent on the temperature in the coating tank. For this reason, in many coating operations, although, of course, the coating metal must be maintained in a liquid state, the temperatures may not exceed certain limits. This conflicts with the desired effect of stripping the coating metal to adjust a certain coating thickness, since the viscosity of the coating metal necessary for the stripping operation increases with decreasing temperature and thus complicates the stripping operation.

To avoid the problems associated with rollers running in the molten coating metal, approaches have been proposed, in which a coating tank is used that is open at the bottom and has a guide channel in its lower section for guiding the strip vertically upward, and in which an electromagnetic seal is used to seal the open bottom of the tank. The production of the electromagnetic seal involves the use of electromagnetic inductors, which operate with electromagnetic alternating or traveling fields that seal the coating tank at the bottom by means of a repelling, pumping, or constricting effect.

A solution of this type is described, for example, in EP 0 673 444 B1. The solutions described in WO 96/03533 and JP 50[1975]-86446 also provide for an electromagnetic seal for sealing the coating tank at the bottom.

Although this allows the coating of nonferromagnetic metal strip, problems arise in the coating of steel strip that is essentially ferromagnetic, because the strip is drawn to the walls of the channel by the ferromagnetism in the electromagnetic seals, and this damages the surface of the strip. Another problem that arises is that the coating metal is unacceptably heated by the inductive fields.

An unstable equilibrium exists with respect to the position of the ferromagnetic steel strip passing through the guide channel between two traveling-field inductors. The sum of the forces of magnetic attraction acting on the strip is zero only in the center of the guide channel. As soon as the steel strip is deflected from its center position, it draws closer to one of the two inductors and moves farther away from the other inductor. The reasons for this type of deflection may be simple flatness defects of the strip. Defects of this type include any type of strip waviness in the direction of strip flow, viewed over the width of the strip (center buckles, quarter buckles, edge waviness, flutter, twist, crossbow, S-shape, etc.). The magnetic induction, which is responsible for the magnetic attraction, decreases in field strength with increasing distance from the inductor according to an exponential function. Therefore, the force of attraction similarly decreases with the square of the induction field strength with increasing distance from the inductor. This means that when the strip is deflected in one direction, the force of attraction to one inductor increases exponentially, while the restoring force by the other inductor decreases exponentially. Both effects intensify by themselves, so that the equilibrium is unstable.

DE 195 35 854 A1 and DE 100 14 867 A1 offer approaches to the solution of this problem, i.e., the problem of more precise position control of the metal strand in the guide channel. According to the concepts disclosed there, the coils for inducing the electromagnetic traveling field are supplemented by correction coils, which are connected to an automatic control system and see to it that when the metal strip deviates from its center position, it is brought back into this position.

In these previously known approaches to a solution of this problem, it was found to be a disadvantage that the automatic control of the metal strip for keeping the strip in the center of the guide channel becomes difficult due to the fact that destructive interference of the fields sometimes occurs due to the superimposing of the magnetic fields of the main coils and correction coils, and therefore efficient restoration of the metal strip to the center of the guide channel becomes difficult or impossible. An analysis of the resisting forces of the steel strip revealed that with decreasing strip thickness, which conforms to the present trend, the inherent stiffness of the steel strip decreases to the extent that the strip can offer very little resistance to deformation by the magnetic field of the inductors. A problem in this regard is the large unsupported length between the lower guide roller below the guide channel and the upper guide roller above the coating bath, which can be well above 20 m in a production plant. This increases the need for efficient position control of the metal strip in the guide channel, which is difficult due to the conditions noted above.

Therefore, the objective of the invention is to further develop a device for the hot dip coating of metal strands of the type specified at the beginning in such a way that the specified disadvantages are overcome. In particular, it should be possible to keep the metal strip in the center of the guide channel in an effective way.

In accordance with the invention, this objective is achieved by arranging at least some of the correction coils, as viewed in the direction of movement of the metal strand, in a staggered fashion relative to one another perpendicular to the direction of movement and perpendicular to the direction normal to the surface of the metal strip.

The correction coils, as viewed in the direction of movement of the metal strip, are preferably arranged in at least two rows, and preferably six rows. In addition, each row can have at least two correction coils. Furthermore, it is advantageous to provide for the center of a correction coil to be arranged in a following row, as viewed in the direction of movement of the metal strand, exactly between two centers of the correction coils of the preceding row.

The advantage obtained with the refinement in accordance with the invention is that, due to the staggered arrangement of the correction coils from row to row (as viewed in the direction of movement of the metal strand), the magnetic fields of traveling-field coils for sealing the guide channel and the magnetic fields of the correction coils for controlling the position of the strip in the guide channel are superimposed on one another to form a common field, which both seals and controls. The invention avoids the problem of destructive interference of the fields due to mutually neutralizing magnetic fields at the boundaries of the correction coils in a row, which otherwise would no longer allow an influence to be exerted on the metal strip in the guide channel for the purpose of controlling its position.

In the arrangement provided for in accordance with the invention, the induction fields are superimposed on one another, and the unwanted effect of destructive interference of the fields on the side is compensated by the correction coil located below it in a staggered position. On the lower side of the inductors, the effect is no longer a problem, since the controlled region for the column of liquid metal is located in the upper half of the guide channel and therefore no longer has an interfering effect in this area.

In accordance with a further development, it is provided that at least one correction coil, as viewed in the direction of movement of the metal strand, is arranged at the same height as each main coil. Furthermore, it can be provided that the electromagnetic inductor has a number of grooves that run perpendicularly to the direction of movement of the metal strand and perpendicularly to the normal direction for holding the main coils and correction coils. In this regard, it can be advantageously provided that at least a part of at least one main coil and at least one correction coil is mounted in each groove. Moreover, it has been found to be advantageous for the part of the correction coil mounted in the groove to be mounted closer to the metal strand than the given part of the main coil.

Special importance is attached to the supplying of both the main coils and the correction coils with alternating current. For this purpose, means are preferably provided by which the main coils can be supplied with three-phase alternating current. It is especially advantageous to install a total of six main coils arranged in succession in the direction of movement of the metal strand (i.e., six rows), which are supplied with three-phase current that differs in phase successively by 60°.

Furthermore, it is proposed that means be used by which the correction coils are supplied with an alternating current that has the same phase as the current with which the locally adjacent main coil is operated.

Current supply with pulse synchronization over optical waveguides can preferably be used for the in-phase supplying of the main coils and correction coils.

This type of refinement of the invention makes it possible to operate the correction coils in phase with the traveling field. Usually three phases of a rotating field are used for the traveling-field inductors; for the correction coils, the respective single phase of the main coil in front of which the correction coil is located is sufficient. For the power supply of the two inductors on either side of the metal strand, three-phase variable-frequency inverters can be used for the traveling field; single-phase variable-frequency inverters are sufficient for the correction coils, specifically, one for each correction coil. The synchronization of the individual variable-frequency inverters is of essential importance in this regard. This can be accomplished in an especially simple way by the aforementioned pulse synchronization over optical waveguides, which is especially advisable due to the strong magnetic fields and their stray fields.

The position of the running steel strip can be detected by induction field sensors, which are operated with a weak measuring field of preferably high frequency. For this purpose, a voltage of higher frequency with low power is superposed on the traveling-field coils. The higher-frequency voltage has no effect on the seal; in the same way, this does not produce any heating of the coating metal or steel strip. The higher-frequency induction can be filtered out from the powerful signal of the normal seal and then yields a signal proportional to the distance from the sensor. The position of the strip in the guide channel can be detected and controlled with this signal.

Studies on the inherent stiffness of the metal strand revealed a definite improvement of the controllability of the metal strip with the proposed refinement of the correction coils. The strip thus no longer has long unsupported lengths in the area of the inductors, and it thus has sufficient inherent stiffness to allow its position to be controlled as it passes through the guide channel.

An embodiment of the invention is illustrated in the drawings.

Figure 1:
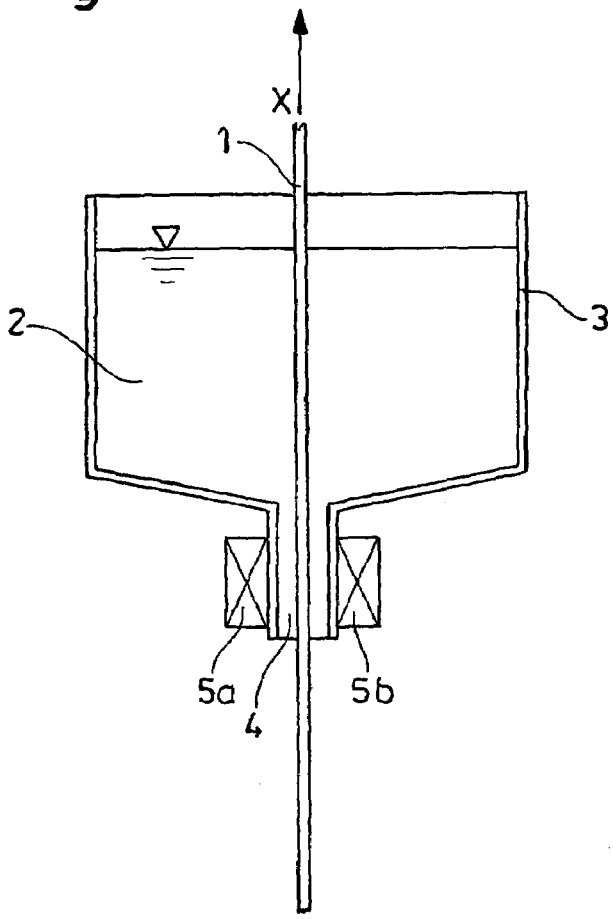
FIG. 1 shows a schematic representation of a hot dip coating tank with a metal strand being guided through it.

FIG. 1 shows the principle of the hot dip coating of a metal strand 1, especially a steel strip. The metal strand 1 that is to be coated enters the guide channel 4 of the coating system vertically from below. The guide channel 4 forms the lower end of a tank 3, which is filled with molten coating metal 2. The metal strand 1 is guided vertically upward in direction of movement X. To prevent the molten coating metal 2 from being able to run out of the tank 3, an electromagnetic inductor is installed in the area of the guide channel 4. It consists of two halves 5*a* and 5*b*, which are installed on either side of the metal strand 1. In the electromagnetic inductor 5, an electromagnetic traveling field is induced, which holds the molten coating metal 2 in the tank 3 and thus prevents it from running out.

Figure 3:
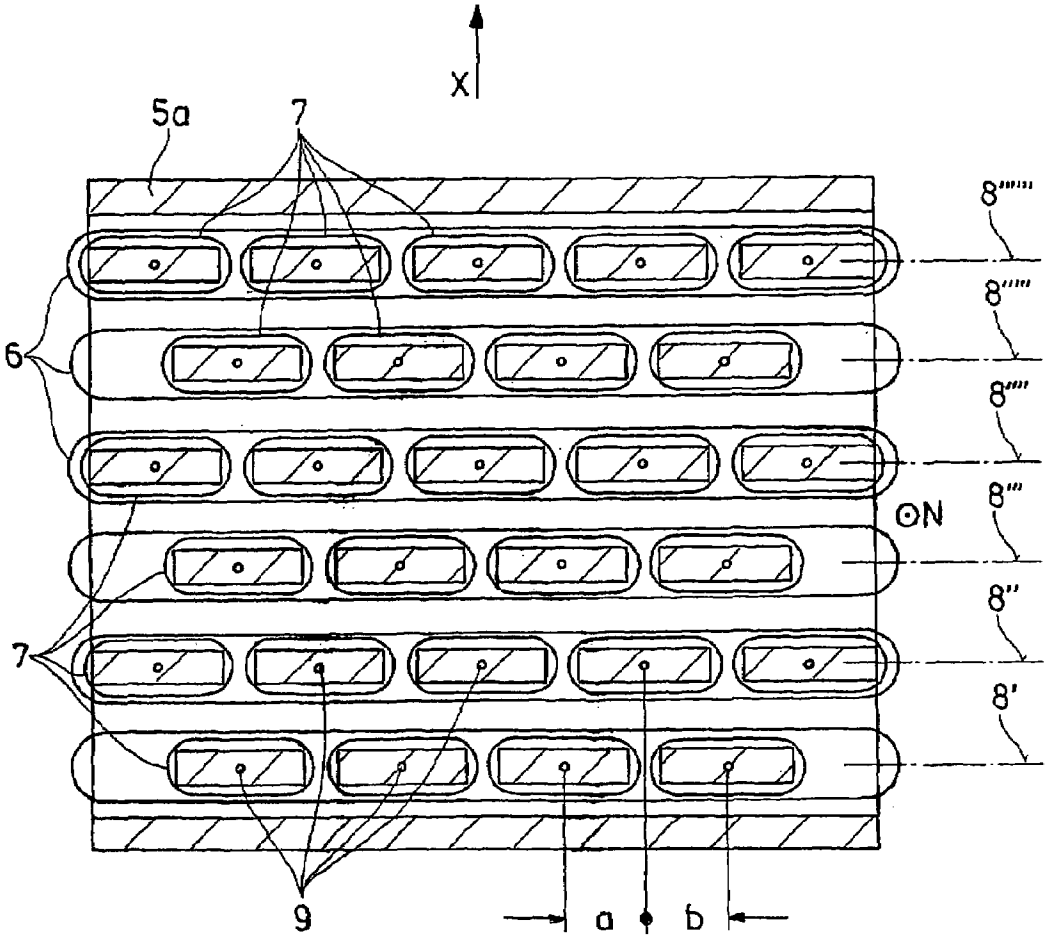
FIG. 3 shows the side view of the electromagnetic inductor corresponding to FIG. 2.
Figure 2:
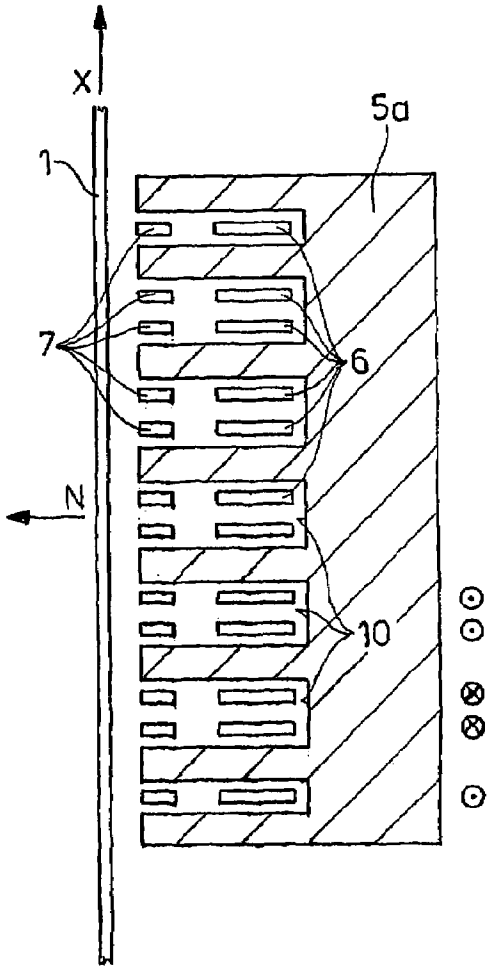
FIG. 2 shows the front view of an electromagnetic inductor, which is installed at the bottom of the hot dip coating tank.

The exact design of the electromagnetic inductor can be seen in FIGS. 2 and 3, which show only one of the two symmetrically designed inductors 5*a*, 5*b*, which are installed on either side of the metal strand 1. As is shown in FIG. 2, the metal strand 1 moves upward past the inductor 5*a* in the direction of movement X. The inductor 5*a* is equipped with a total of six main coils 6 for induction of the electromagnetic traveling field. The main coils extend over the entire width of the inductor 5*a* (see FIG. 3). The main coils 6 are mounted in grooves 10, which are incorporated in the metallic foundation of the inductor 5*a*. The current directions are indicated on the right side of FIG. 2 for a total of five line sections of the main coils 6, as they either emerge from the plane of the drawing or enter the plane of the drawing.

To allow the metal strand 1 to be held exactly in the center of the guide channel 4 in the direction N normal to the surface of the strand 1 (see FIG. 2 and FIG. 3) without hitting the inductors 5*a*, 5*b*, correction coils 7 are mounted in the inductors 5*a*, 5*b*. As especially FIG. 3 shows, several correction coils 7 are positioned side by side in each of the total of six rows 8', 8", 8'", 8"", 8'"", 8""". The main coil 6, which extends over the entire width of the inductor 5*a*, and several correction coils 7, which are positioned side by side, are mounted in two adjacent grooves 10.

As FIG. 3 shows, the coils are arranged in such a way that the correction coils 7 of two successive rows 8', 8", 8'", 8"", 8'"", 8""" are staggered relative to one another. The center of the correction coils is labeled with reference number 9. As is apparent from the bottom right of FIG. 3, the distances a and b are the same and indicate the amount of offset of the correction coils 7 relative to one another. This refinement ensures that the magnetic fields induced by the correction coils 7, which control the position of the metal strand 1 in the guide channel 4, cannot destructively interfere with one other. This allows efficient position control.

Figure 4:
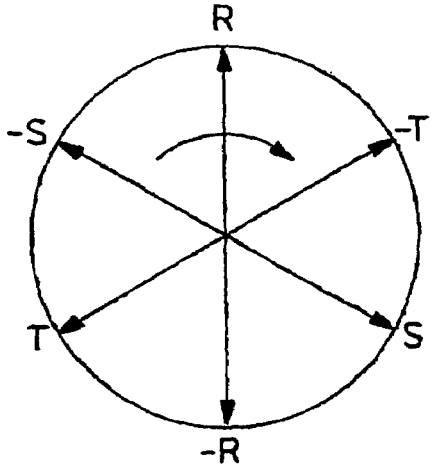
FIG. 4 shows the phase sequence of the electromagnetic traveling field induced by the electromagnetic inductor.

FIG. 4 shows the phase sequence of the three-phase current, as it exists in the six main coils 6 shown in the drawings. The three phases are labeled R, S, and T. The phase sequence is R, -T, S, -R, T, -S.

Each correction coil 7 must be driven with the same phase that is present in the main coil 6 in front of which the given correction coil 7 is positioned. The main coils 6 for the induction of the traveling field are thus driven with three phases of a rotating field, while each of the correction coils 7 is supplied with only one phase. The supplying of the coils 6 and 7 with phase-exact directional current is realized by means of suitable and sufficiently well-known variable-frequency inverters, which must be suitably synchronized, for which purpose especially pulse synchronization over optical waveguides is well suited.

LIST OF REFERENCE NUMBERS

1 metal strand (steel strip)
2 coating metal
3 tank
4 guide channel
5, 5*a*, 5*b* electromagnetic inductor
6 main coil
7 correction coil
8', 8", 8'", 8"", 8'"", 8""" rows
9 center of a correction coil 7
10 groove
X direction of movement
N normal direction
a distance between the centers 9
b distance between the centers 9
R phase of the three-phase current
S phase of the three-phase current
T phase of the three-phase current

What is claimed is:

1. Device for the hot dip coating of metal strand (1), especially steel strip, in which the metal strand (1) can be passed vertically through a tank (3) that contains the molten coating metal (2) and through an upstream guide channel (4), wherein, in the area of the guide channel (4), an electromagnetic inductor (5) is installed, which can induce induction currents in the coating metal (2) for holding back the coating metal (2) in the tank (3) by means of an electromagnetic traveling field, which induction currents interact with the electromagnetic traveling field to exert an electromagnetic force, and wherein the inductor (5) has at least two main coils (6), which are arranged in succession in the direction of movement (X) of the metal strand (1), and at least two correction coils (7), which serve to control the position of the metal strand (1) in the guide channel (4) in the direction (N) normal to the surface of the metal strand (1) and are also arranged in succession in the direction of movement (X) of the metal strand (1), wherein at least some of the correction coils (7), as viewed in the direction of movement (X) of the metal strand (1), are arranged in a staggered fashion relative to one another perpendicular to the direction of movement (X) and perpendicular to the direction (N) normal to the surface of the metal strip (1).

2. Device in accordance with claim 1, wherein the correction coils (7), as viewed in the direction of movement (X) of the metal strand (1), are arranged in at least two rows (8', 8", 8'", 8"", 8'"", 8""").

3. Device in accordance with claim 2, wherein each row (8', 8", 8'", 8"", 8'"", 8""") has at least two correction coils (7).

4. Device in accordance with claim 3, wherein the center (9) of a correction coil (7) in a following row (8"), as viewed in the direction of movement (X) of the metal strand (1), is arranged between two centers (9) of the correction coils (7) of the preceding row (8').

5. Device in accordance with claim 1, wherein at least one correction coil (7), as viewed in the direction of movement (X) of the metal strand (1), is arranged at the same height as each main coil (6).

6. Device in accordance with claim 1, wherein the electromagnetic inductor (5) has a number of grooves (10) that run perpendicularly to the direction of movement (X) of the metal strand (1) and perpendicularly to the normal direction (N) for holding main coils (6) and correction coils (7).

7. Device in accordance with claim 6, wherein at least a part of at least one main coil (6) and at least one correction coil (7) is mounted in each groove (10).

8. Device in accordance with claim 7, wherein the part of the correction coil (7) mounted in the groove (10) is mounted closer to the metal strand (1) than the given part of the main coil (6).

9. Device in accordance with claim 1, providing means for supplying the main coils (6) with three-phase alternating current.

10. Device in accordance with claim 9, wherein a total of six main coils (6) arranged in succession in the direction of movement (X) of the metal strand (1), which are supplied with three-phase current that differs in phase successively by 60°.

11. Device in accordance with claim 9, providing means for supplying the correction coils (7) with an alternating current that has the same phase as the current supplied to the locally adjacent main coil (6).

12. Device in accordance with claim 11, wherein the means for supplying the main coils (6) and the correction coils (7) with alternating current has a device for pulse synchronization over optical waveguides.

13. Device in accordance with claim 1, as viewed in the direction of movement (X) of the metal strand (1), are arranged in six rows (8', 8", 8''', 8'''', 8''''', 8'''''').

* * * * *